US005570841A

United States Patent [19]

Pace et al.

[11] Patent Number: 5,570,841

[45] Date of Patent: Nov. 5, 1996

[54] MULTIPLE DISK SWIRL ATOMIZER FOR FUEL INJECTOR

[75] Inventors: Jeffrey B. Pace, Newport News; Vernon R. Warner, Wicomico; John F. Nally, Jr., Williamsburg, all of Va.

[73] Assignee: Siemens Automotive Corporation, Auburn Hills, Mich.

[21] Appl. No.: 320,027

[22] Filed: Oct. 7, 1994

[51] Int. Cl.[6] ..... F02M 51/06; F02M 61/16

[52] U.S. Cl. ..... 239/585.1; 239/496; 239/497; 239/533.12

[58] Field of Search ..... 239/486, 494, 239/496, 497, 533.12, 596, 585.1

[56] References Cited

U.S. PATENT DOCUMENTS

| | | | |
|---|---|---|---|
| 1,194,051 | 8/1916 | Mejani | 239/485 |
| 2,746,801 | 5/1956 | Curran | 239/494 |
| 4,040,396 | 8/1977 | Tomita | 239/494 |
| 4,120,456 | 10/1978 | Kimura et al. | 239/533.12 |
| 4,854,024 | 8/1989 | Grieb et al. | 29/890.132 |
| 4,907,746 | 3/1990 | Aichele et al. | 239/533.12 |
| 5,174,505 | 12/1992 | Shen | 239/417.3 |
| 5,244,154 | 9/1993 | Buchholz et al. | 239/533.12 |
| 5,285,970 | 2/1994 | Maier et al. | 239/533.12 |

FOREIGN PATENT DOCUMENTS

| | | | |
|---|---|---|---|
| 919215 | 3/1947 | France | 239/486 |
| 641510 | 8/1950 | United Kingdom | 239/486 |

*Primary Examiner*—Andres Kashnikow
*Attorney, Agent, or Firm*—Russel C. Wells

[57] ABSTRACT

Multiple orifice disks are stacked and include one or more swirl disks. The effect of the stack of disks is to impart swirl to the fuel stream being ejected from the injector in a relatively short axial length. The geometry of the disks in the stack are such that the fuel from the top disk enters the bottom disk at the end of a pattern which operates to impart a swirl component to the fuel. The pattern in the bottom disk is typically a two layered pattern wherein the top layer is one half the thickness of the thin disk and the bottom layer is the second half of the thickness of the thin disk.

5 Claims, 2 Drawing Sheets

MULTIPLE DISK SWIRL ATOMIZER FOR FUEL INJECTOR

FIELD OF THE INVENTION

This invention relates generally to electrically operated fuel injectors of the type that inject volatile liquid fuel into an induction intake system of an automotive vehicle internal combustion engine, and in particular the invention relates to a disk stack for improving the atomization of fuel exiting such a fuel injector.

BACKGROUND AND SUMMARY OF THE INVENTION

Commonly assigned U.S. Pat. No. 4,854,024 discloses plural thin disk orifice members forming a stack at the nozzle from which liquid fuel is injected from the injector and into the engine. This disk stack is disposed downstream of the electrically operated valve mechanism that controls flow through the fuel injector.

Fuel injectors that impart swirl to the injected fuel, such as commonly assigned U.S. Pat. No. 5,170,945 issued Dec. 15, 1992 and entitled "Fuel Injector That Swirls and Throttles The Flow To Create A Torodial Fuel Cloud", typically have swirl passages disposed upstream of the valve seat. The usual purpose for imparting swirl is to improve the quality of fuel atomization.

The present invention relates to a novel means for imparting swirl to fuel that is capable of attaining even greater improvement in fuel atomization by incorporating the swirl producing means into a disk stack at the nozzle of a fuel injector. Swirl can thereby be accomplished in a relatively short axial length of the fuel injector, downstream of the valve seat.

The foregoing, along with additional features, advantages, and benefits of the invention, will be seen in the ensuing description and claims which are accompanied by drawings. The drawings disclose a presently preferred embodiment of the invention according to the best mode contemplated at this time in carrying out the invention.

DESCRIPTION OF THE PREFERRED EMBODIMENT

Figure 1:
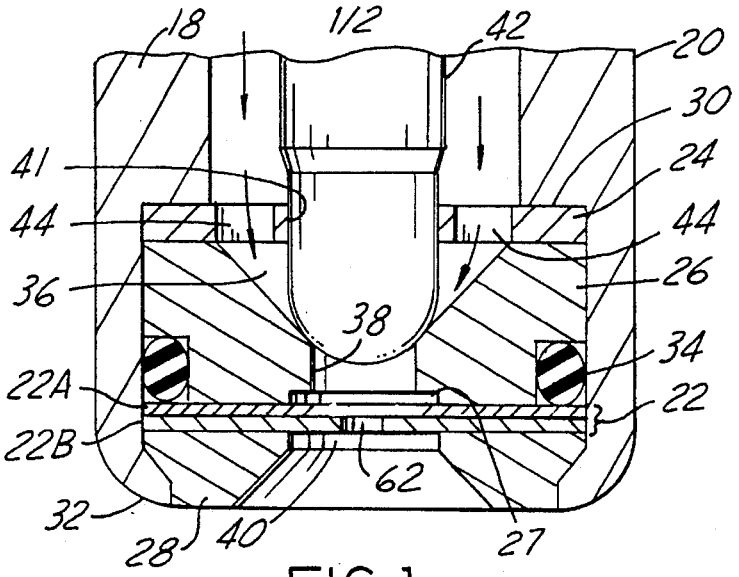
FIG. 1 is fragmentary longitudinal cross-sectional view through the nozzle end of a fuel injector embodying a disk stack at the nozzle according to the present invention.
Figure 2:
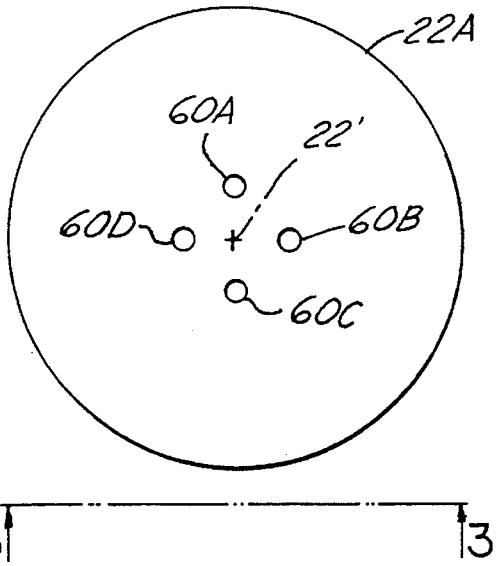
FIG. 2 is a plan view of one disk of a first embodiment by itself.
Figure 4:
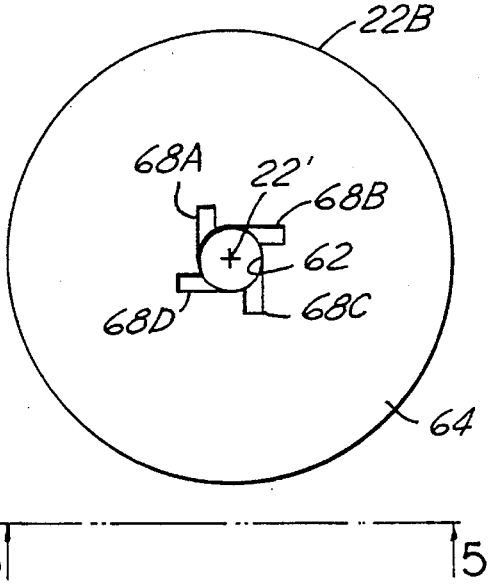
FIG. 4 is a plan view of another disk of the first embodiment by itself.
Figure 3:
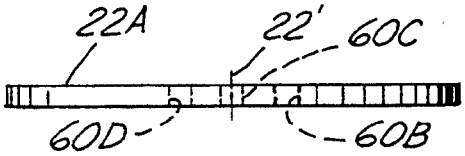
FIG. 3 is an edge view in the direction of arrows 3—3 in FIG. 2.
Figure 5:
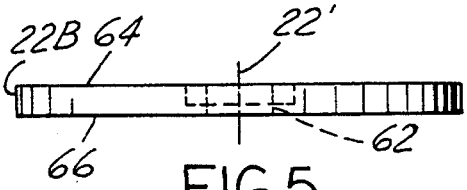
FIG. 5 is an edge view in the direction of arrows 5—5 in FIG. 4.
Figure 6:
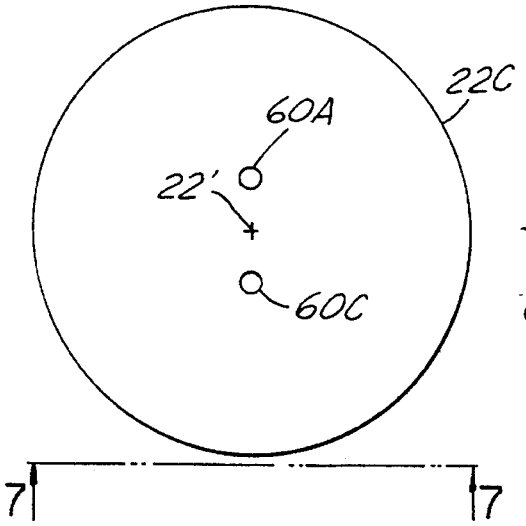
FIG. 6 is a plan view of one disk of a second embodiment by itself
Figure 8:
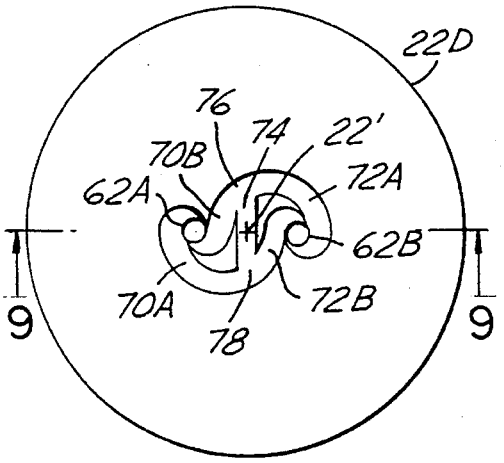
FIG. 8 is a plan view of another disk of the second embodiment by itself.
Figure 7:
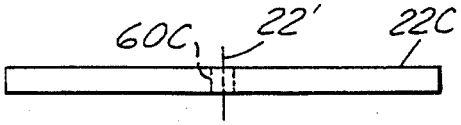
FIG. 7 is an edge view in the direction of arrows 7—7 in FIG. 6.
Figure 9:
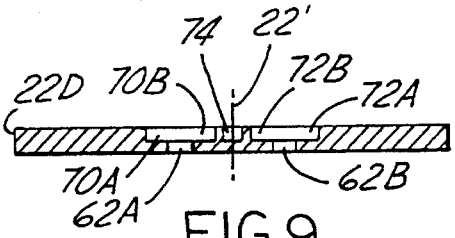
FIG. 9 is a cross section in the direction of arrows 9—9 in FIG. 8.

FIG. 1 shows the nozzle end of a body 18 of a solenoid operated fuel injector 20 having a thin disk orifice member stack 22 embodying principles of the invention. The construction of fuel injector 20 is generally like that disclosed in commonly assigned U.S. Pat. Nos. 4,854,024 and 5,174,505 with respect to details that are not specifically portrayed in FIG. 1. The nozzle end of fuel injector 20 is also like those of the aforementioned patents in that stack 22 is part of a larger stack comprising a needle guide member 24 and a valve seat member 26 which are disposed axially interiorly of stack 22, while an annular retainer member 28 is disposed exteriorly of stack 22, and the entire stack is axially captured in the nozzle end between an internal shoulder 30 of body 18 and a short inwardly turned lip 32 at the end of the body. The O.D. of the stack is sealed to the I.D. wall of the body by the usual O-ring seal 34.

Seat member 26 comprises a frustoconical seat 36 that leads from guide member 24 to a central passage 38 of member 26 that includes a counterbore 27 and in turn leads to a central region of stack 22. Retainer member 28 comprises a passage 40 from stack 22 that opens to the open end of the nozzle. Guide member 24 comprises a central guide hole 41 for guiding the axial reciprocation of a needle 42 and several through-holes 44 distributed around hole 40 to provide for fuel to flow through member 24 to the space around seat 36. The arrows in FIG. 1 show the direction of fuel flow although it can be seen in that FIG. that the rounded tip end of needle 42 is seated on seat 36 closing the fuel injector to flow. When needle 42 is unseated, fuel passes to passage 38, through orifice means in stack 22 and, through passage 40 to be injected from the nozzle into an induction intake system of an internal combustion engine.

As noted earlier, the invention relates to the novel construction of stack 22, full detail of which can be seen by also considering the remaining Figures.

The first example of stack 22 that is represented by FIGS. 2–5 comprises a first circular disk 22A and a second circular disk 22B. Both disks 22A, 22B are flat, of equal diameters, and are disposed face-to-face against each other, with disk 22A being upstream of disk 22B. The central axis of the stack, which is coincident with that of the fuel injector, is designated by the reference 22'.

Disk 22A comprises four circular through-orifices 60A, 60B, 60C, and 60D arranged symmetrically 90 degrees apart about central axis 22' and having their centers lying on a common circle. Disk 22B comprises a central circular through-orifice 62 extending from the disk's upstream face 64 to its downstream face 66. Upstream face 64 comprises four separate channels 68A, 68B, 68C, and 68D. Each channel is arranged to be substantially tangent to through-orifice 62 and arranged 90 degrees from the immediately clockwise and counter clockwise channels so that the channels are arranged in a symmetrical pattern about axis 22'.

In the assembled fuel injector, the two disks 22A, 22B are circumferentially positioned such that each of the through-orifices of disk 22A registers with a respective one of the channels of disk 22B proximate the end of the channel most distant from through-orifice 62, but in full communication with, the channel.

When the fuel injector is open, fuel passes through each of the individual through-orifices of disk 22A to enter a respective channel of disk 22B. The organization and arrangement of the channels is such that the fuel is forced to flow into through-orifice 62 with a tangential component of velocity that is additional to the axial component of velocity with which the fuel is forced through orifice 62. In this way, the fuel flowing through and exiting orifice 62 has swirl imparted to it.

The second example which is represented by FIGS. 6–9 also comprises a two disk stack composed of an upstream disk 22C and a downstream disk 22D that are of equal diameters and disposed face-to-face against each other. Disk 22C has only two through-orifices 60A and 60C symmetrically diametrically opposite each other about the disk axis.

Disk 22D has two outlet through-orifices 62A, 62B lying on a common diameter equally distant from the axis of the disk. Disk 22D also comprises plural channels 70A, 70B, 72A, 72B and 74. In the assembled fuel injector, the two through-orifices 60A, 60C lie on a diameter that is at 90 degrees to the diameter on which through-orifices 62A, 62B lie. Fuel that passes through through-orifice 60A, enters channels of disk 22D at the location 76 while that from through-orifice 60C enters at the location 78.

Channel 72A curves from location 76 to through-orifice 62B in the manner shown, while channel 70A does similarly from location 78 to through-orifice 62A. Through-orifice 62A is also served by channel 70B curving from location 76 to through-orifice 62A and similarly through-orifice 62B is served by channel 72B curving from location 78 to through-orifice 62B. Thus, each through-orifice 62A, 62B is served by two of the channels which intercept diametrically opposite portions of the through-orifices. The curvature of each of the four channels of disk 22D is such that the pressurized fuel is being forced against the outside sidewall surface of the channel as it flows through the channel, and as a result, it will enter the respective through-orifice 62A, 62B with a swirling motion which provides a tangential component of velocity in addition to the axial component. Consequently, fuel flows through and out the respective through-orifices 62A, 62B with a swirling motion. Channel 74 extends between the through-orifices 60A and 60C.

Figure 10:
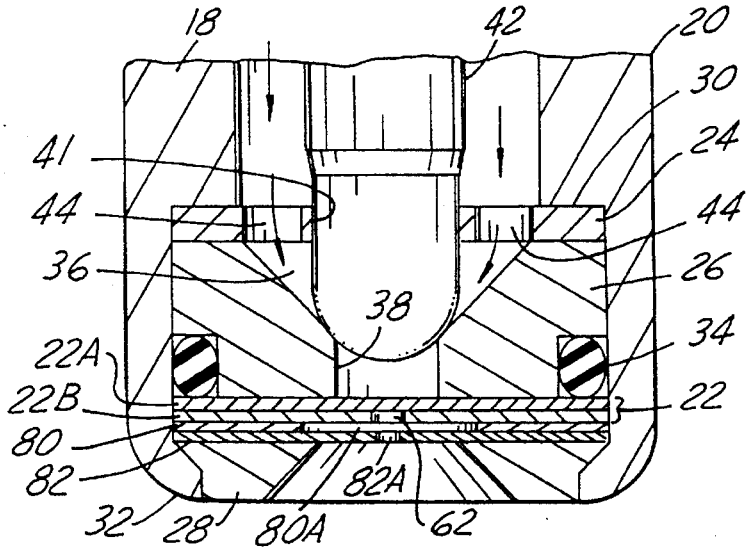
FIG. 10 is a cross-sectional view in the same direction as FIG. 1 showing the addition of two additional disks to a stack.

FIG. 10 shows a further example in which two additional disks 80, 82 have been added to the downstream side of the stack. FIG. 10 shows the two upstream disks by way of example as disks 22A, 22B. Disk 80 comprises a large circular hole 80A that is co-axial with the stack axis while disk 82 comprises a much smaller diameter circular hole 82A that is also co-axial. Hole 80A, in cooperation with disk 82 and disk 22B results in the creation of a swirl chamber in the space of hole 80A. This helps in forming a vortex and provides control of the spray angle. It is possible that disk 80 could be integrated with either disk 82 or disk 22B in which case a three disk stack would result.

In the two embodiments of FIGS. 2–9, the channels are formed exclusively in the downstream disk so that the cooperating portion of the upstream disk overlying the channels is flat. Although the disks are thin (0.008", for example), the channels can be formed by conventional processes such as electroforming, EDM, etching, fine-blanking, or micromachining processes. The disks can be fabricated from stainless steel or silicon, both of which are conventional materials for fuel injector disks.

While a presently preferred embodiment of the invention has been illustrated and described, it should be appreciated that principles are applicable to other embodiments.

What is claimed is:

1. A multiple disk swirl atomizer nozzle for an electrically operated fuel injector from which fuel is injected into an engine, the nozzle comprising:

first and second thin disks disposed proximate to and concentric with the nozzle, said first disk disposed upstream from and concentric to said second disk and having respective areas of each disk disposed face-to-face against each other;

said first disk having four equal circular orifices equal and angularly spaced about a central axis of said disk with their centers lying on a common circle;

said areas cooperatively define between themselves four channels into which each of said orifices respectively delivers fuel, said channels are provided exclusively in said second disk having a channel depth less than the thickness of said second thin disk so that the cooperating area of said first disk is flat;

said second disk comprises an orifice, along the central axis of said second disk, each of said channels extending in a direction away from said central axis and tangentially to the circumference of said orifice for conveying fuel;

said channels for imparting a tangential component of velocity to fuel passing axially through and exiting said orifice in said second disk.

2. A multiple disk swirl atomizer nozzle as set forth in claim 1 wherein said thin disks are each less than 0.010 inches (2.5 mm) thick.

3. A multiple disk swirl atomizer nozzle for an electrically operated fuel injector from which fuel is injected into an engine, the nozzle comprising:

first and second thin disks disposed proximate to and concentric with the nozzle, said first disk disposed upstream from and concentric to said second disk and having respective areas of each disk disposed face-to-face against each other;

said first disk having two equal circular orifices lying on a first common diameter and equally distant from the axis of said first disk; and said second disk having two equal circular orifices lying on a second common diameter perpendicular to said first common diameter and equally distant from the axis of said second disk, two curved channels extending between said orifices and intersecting said orifices at diametrically opposite portions of said orifices, and a third channel extending between said orifices in said second disk and intersecting each of said curved channels, such that a tangential component of velocity is imparted to fuel in said channels and exiting said orifices in said second disk.

4. A multiple disk swirl atomizer nozzle as set forth in claim 3 wherein said channels are curved such that the tangential component of velocity is created by the flow through said channels.

5. A multiple disk swirl atomizer nozzle as set forth in claim 3 wherein said channels are provided exclusively in said second disk having a channel depth less than the thickness of said second thin disk so that the respective area of said first disk is flat.

* * * * *